United States Patent [19]

Elliott

[11] Patent Number: 4,630,459

[45] Date of Patent: Dec. 23, 1986

[54] AUTOMATIC COAXIAL CABLE BENDING APPARATUS

[75] Inventor: George A. Elliott, Maple Shade, N.J.

[73] Assignee: RCA Corporation, Princeton, N.J.

[21] Appl. No.: 740,716

[22] Filed: Jun. 3, 1985

[51] Int. Cl.[4] ..... B21D 7/02

[52] U.S. Cl. ..... 12/307; 72/318; 72/422; 226/149

[58] Field of Search ..... 72/307, 306, 318, 384, 72/388, 422; 226/149, 147, 150, 151

[56] References Cited

U.S. PATENT DOCUMENTS

| | | | |
|---|---|---|---|
| 1,720,133 | 7/1929 | LeRoy | 72/452 |
| 2,473,543 | 6/1949 | Randolph | 226/151 |
| 3,553,990 | 1/1971 | Suding et al. | 72/14 |
| 3,592,029 | 7/1971 | Ritter | 72/14 |
| 3,611,770 | 10/1971 | Kralowetz | 72/422 |
| 3,788,116 | 1/1974 | Fazzani | 72/318 |
| 3,821,525 | 6/1974 | Eaton et al. | 235/151.1 |
| 3,845,650 | 11/1974 | Romanov et al. | 72/318 |
| 4,218,817 | 8/1980 | Takano | 29/751 |

FOREIGN PATENT DOCUMENTS

| | | | |
|---|---|---|---|
| 2826804 | 12/1979 | Fed. Rep. of Germany | 72/422 |
| 311505 | 6/1976 | U.S.S.R. | 72/422 |
| 721194 | 3/1980 | U.S.S.R. | 72/422 |

OTHER PUBLICATIONS

"Instruction Manual for Conrac Bendmaster Model 401 (10) Synchro-Bend," Dec. 1972, Conrac Corporation, pp. 1A and 2-25.

Military Specification Sheet, MIL-C-17/1300, Oct. 9, 1979, pp. D/11-D/14 and E-1.

*Primary Examiner*—Daniel C. Crane

*Attorney, Agent, or Firm*—Joseph S. Tripoli; William Squire

[57] ABSTRACT

A chuck secures a rigid coaxial cable to a reference machine plane. A rotatable pressure die automatically engages and bends the cable relative to both a bend die, which is rotatable about a fixed axis, and a fixed support die. The support die absorbs the brunt of the bend forces created by the pressure die and supports the cable as it is displaced by the machine carriage between bending operations. A cable clamp automatically selectively holds the cable and is lowered out of the way of the chuck to permit bending of the cable close to the chuck. The clamp jaws, pressure die, and chuck are adjustable to preclude damage to the cable.

13 Claims, 11 Drawing Figures

AUTOMATIC COAXIAL CABLE BENDING APPARATUS

The United States Government has rights in this invention pursuant to Contract No. N00024-82-C-5110 awarded RCA Corporation by the Department of the Navy.

This invention relates to an apparatus for bending coaxial cables.

Certain coaxial cables include a center conductor, a tubular dielectric element, and a relatively rigid copper alloy tubular outer conductor surrounding the dielectric element, all of which are concentric. These coaxial cables are manufactured straight and are later required to be bent into tortuous shapes for some implementations.

Because of the relative high frequency of the electrical signals carried by these cables, the concentric dimensions of the center conductor to the dielectric and to the outer conductor are critical. If any portion of the outer conductor is distorted from the concentric spacing, the cable's electrical characteristics are seriously effected. For example, U.S. Government Military Specification MIL-C-17/1300, dated Oct. 9, 1979, lists the specifications for a 0.141 diameter rigid coaxial cable. The various cable characteristics which are critical include eccentricity of the elements, adhesion of conductors, dimensional stability, frequency response, ability to withstand certain voltages, corona effects, characteristic impedance, attenuation and return loss, capacitance, and other factors in accordance with a given implementation.

Additional requirements are imposed upon the cable by specific implementations including the need to bend the cable into a tortuous path. The spacing of the cable bends and the radii of the bends may be required to have a tolerance range within a small fraction of an inch, for example, 0.005 inch. Present day commercially available bending apparatuses are generally designed for tubes and do not reliably bend such coaxial cables to the required angles and spacing between bends.

One manually-operated bending apparatus in wide use, which is designed to bend metal tubes to non-critical dimensions, suffers from a number of drawbacks when used to bend coaxial cables. In this apparatus headstock carriage stops are manually set in place along the carriage path. These stops determine the distance between bends by stopping the headstock at appropriate intervals in the bending process. Alignment of the stops is made by "eye" to a reference graduated scaled rule attached to the carriage bed over which the headstock travels. This is relatively inaccurate for a cable system having bend spacing tolerances in the above-noted range. Further, the tube is secured to a chuck secured to a rotatable spindle on the headstock. The chuck is manually rotated with a mechanism scaled in one-degree increments. The chuck is rotated a given angular amount by visually observing the angular markings which observations are relatively inaccurate.

The bend portion of the apparatus includes a bend die rigidly fixed in place on a given bend axis and a pressure die comprising a rotatable grooved wheel mounted on a toggle mechanism which is manually rotated about the bend die axis. The toggle mechanism manually engages the pressure die with the cable. A manually-operated toggle clamp clamps the cable to the bend die at a region closely spaced to the bend region in the space between the pressure die and the chuck. The pressure die and toggle clamp each include a yoke and slider which slides through and is guided by the yoke. This arrangement tends to wear and exhibit excess play in a number of different directions not compensated for by radial adjustments in the mechanism normal to the tube length dimension. This play leads to further inaccuracies.

Bends are progressively formed in the cable by manually displacing the carriage to each of the carriage stops. Each time the carriage and tube attached thereto is displaced, the pressure die and cable clamp need to be released, resulting in a need for the operator to hold the cable free end to preclude cable damage due to scraping against the mechanisms. In use, the bends are often the wrong angles, are at the wrong locations, and more importantly, the outer conductor at the bends tends to be damaged or distorted.

There is an automatic tube bending apparatus described in U.S. Pat. No. 3,821,525. However, the tubes designed to be bent by this apparatus are also non-critical metal pipes such as used, for example, in vehicle exhaust systems. The machine includes a wiper die and pressure die which grip a portion of the tube to be bent behind the bend and a clamp die which grips a portion of the tube ahead of the bend. The clamp die rotates about the bend axis and tends to pull the tube about the bend die rotating the tube around the bend. This pulling action tends to elongate the tube or, in the case of a coaxial cable, the outer conductor. Such elongation of the outer conductor of a coaxial cable is undesirable. This distortion tends to crush the dielectric portion and detrimentally effect the cable's electrical properties. Further, the pressure die and clamp dies are shown schematically and do not deal with the critical nature of coaxial cable dimensions as might occur due to wear of the die mechanisms.

In addition, the patent is silent as to the tube alignment after the clamp and pressure dies are released. In practice, long small diameter coaxial cables, for example, four foot lengths of 0.141 inch outer diameter cable when supported at only one end tend to be relatively flexible with the free end tending to move about. Thus, when the free end of the cable is released by the clamp and pressure dies that end is assumed to be manually supported. This problem is not addressed by the patent or prior manual apparatus. Automatic axial displacement of a coaxial cable upon release of the end at the clamp and pressure dies would tend to damage the cable. This kind of damage as well as elongation at the bend may not be a problem with tubes generally, but is unacceptable in certain coaxial cables.

Further, it is sometimes desirable to make the bends close to both ends of the cable. A bend between the clamp bend die and the chuck of the aforementioned patent cannot be easily made because of the presence of the wiper and pressure dies in that space. In the manual system, the bends can be made closer to the cable end, but the clamp with its movable parts is used to bear the brunt of the bend reaction forces and tends to wear undesirably.

An automatic coaxial cable bending apparatus according to the present invention comprises a chuck for automatically locating an end of the cable at a reference point on a given axis. Cable positioning apparatus automatically selectively move the chuck so that the reference point and cable end are displaced to a second point on the axis. The cable positioning apparatus includes means for automatically selectively rotating the chuck and the cable about the axis. Bending apparatus includes a cable pressure die for automatically engaging and bending the cable at a third point on the cable spaced a predetermined distance from the second point. Such bending is accomplished with negligible distortion of the cable so that the electrical characteristics of the cable are substantially unchanged. The bending apparatus includes a bend die rotatable about a stationary axis and a stationary cable support die fixed in place relative to the bend die. The bend and support dies are adapted to support the cable free end during the selected moving of the chuck means. The pressure die is adapted to rotate relative to and about the bend die in a direction away from the support die during the bending engaged state and to automatically return to the initial position in the opposite direction in the disengaged state.

Figure 1:
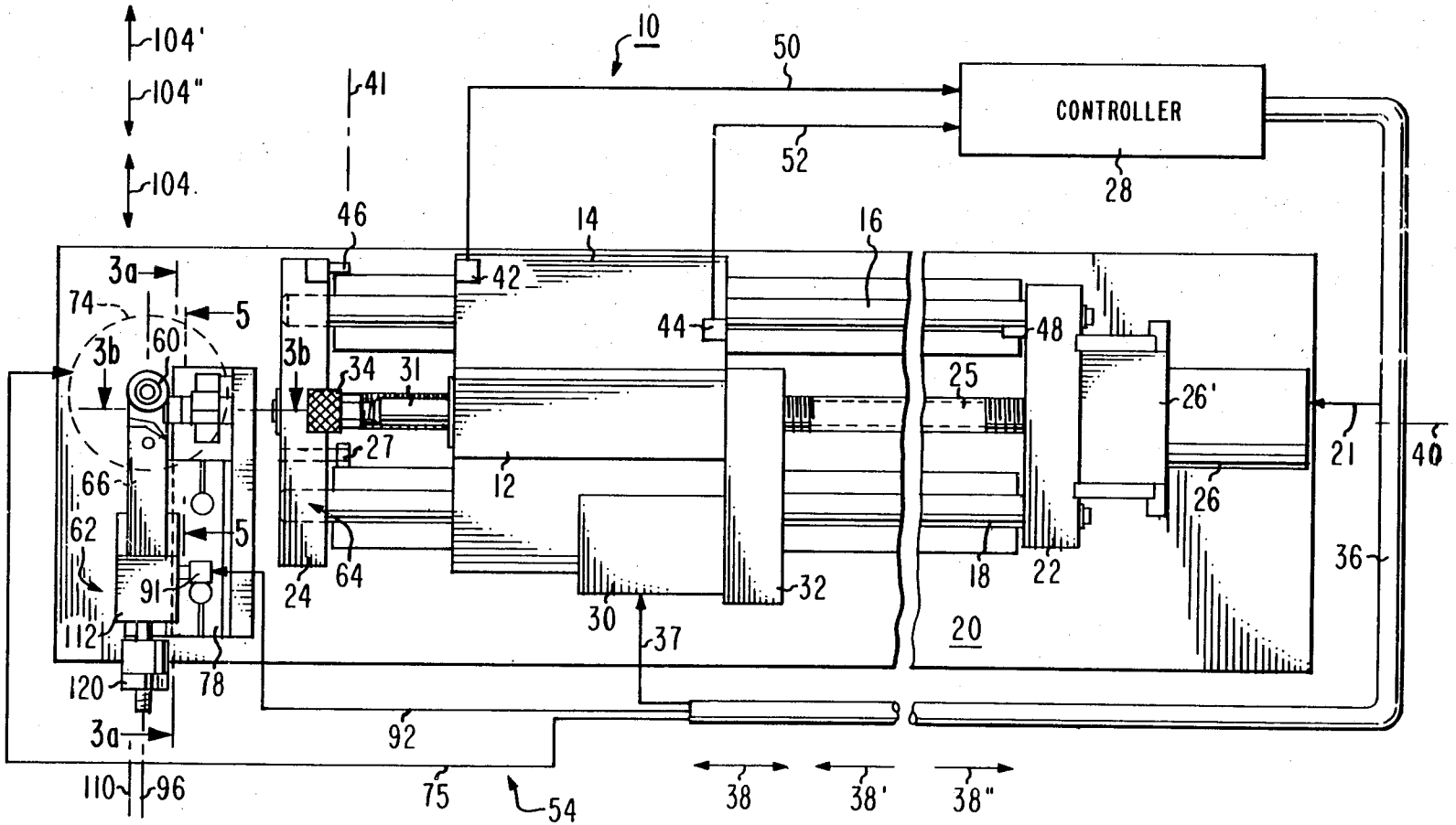
FIG. 1 is a plan, fragmented view of a coaxial cable bending apparatus in accordance with one embodiment of the present invention.
Figure 3B:
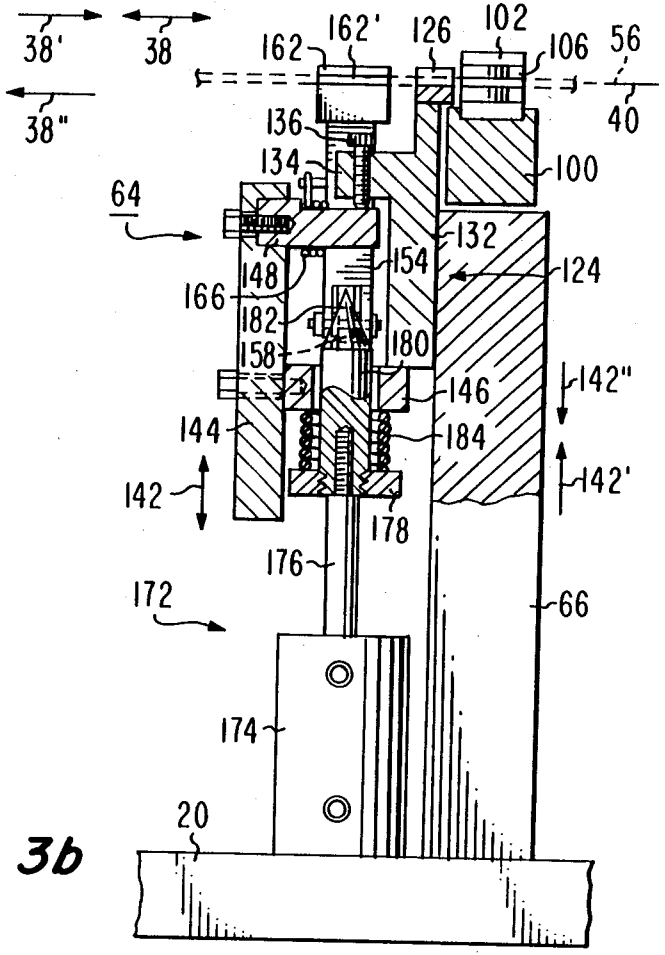
Figure 3A:
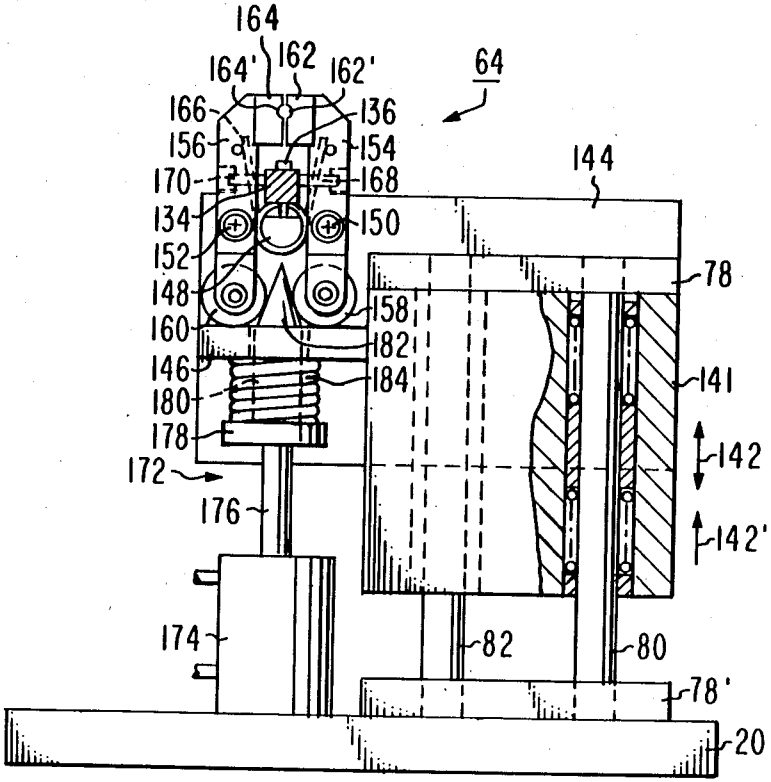

FIG. 3*a* is a sectional view of the apparatus of FIG. 1 taken along lines 3*a*–3*a;*

FIG. 3*b* is a sectional elevation view of the apparatus of FIG. 1 taken along lines 3*b*—3*b;*

Figure 4B:
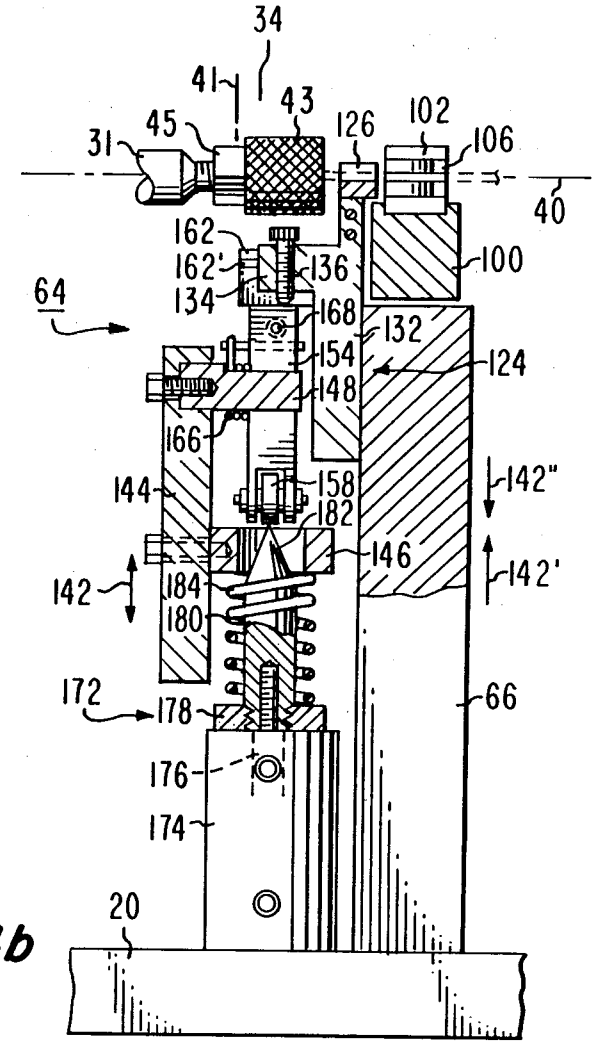
Figure 4A:
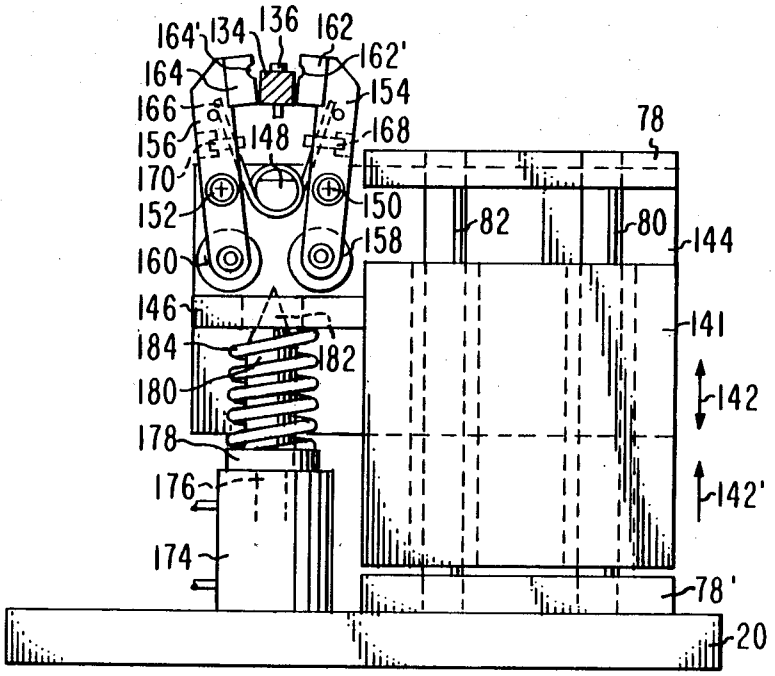
Figure 5:
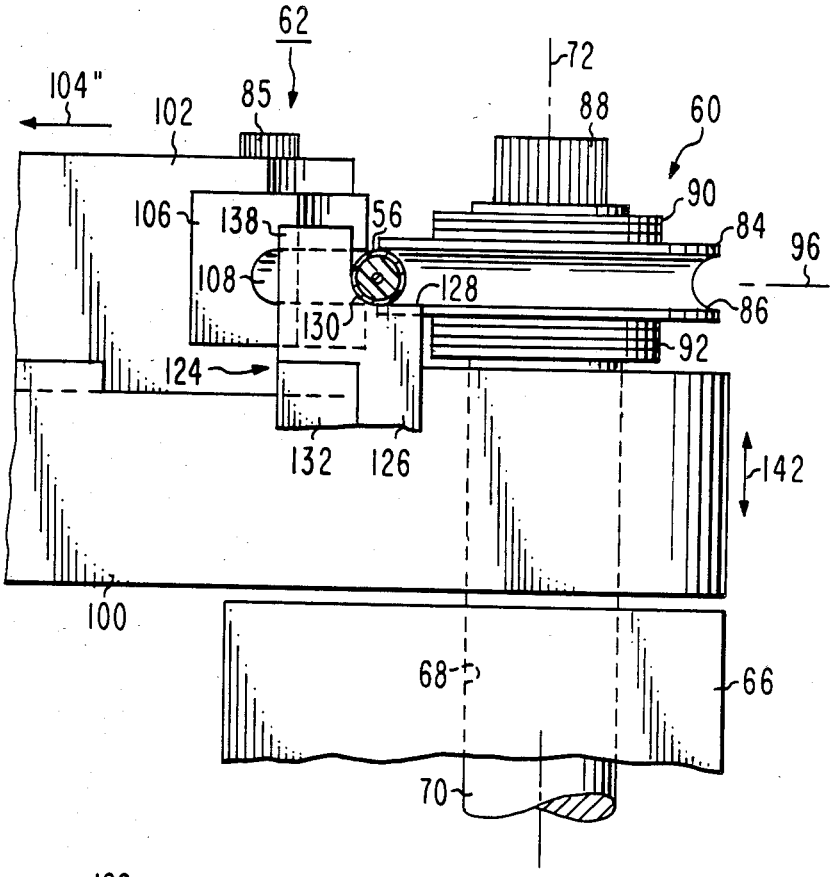
Figure 9:
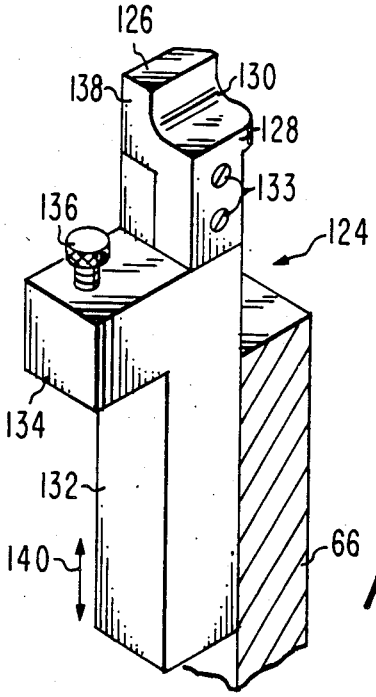
Figure 6:
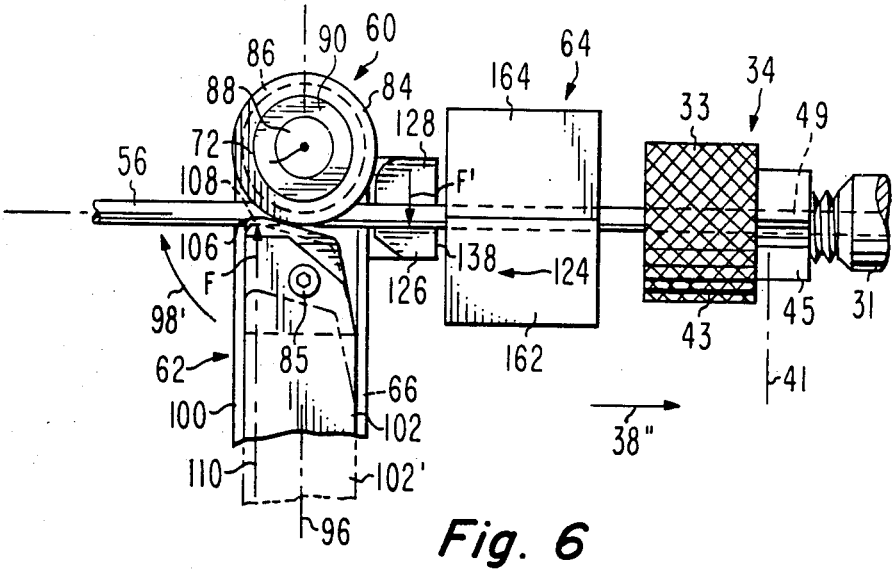
Figure 7:
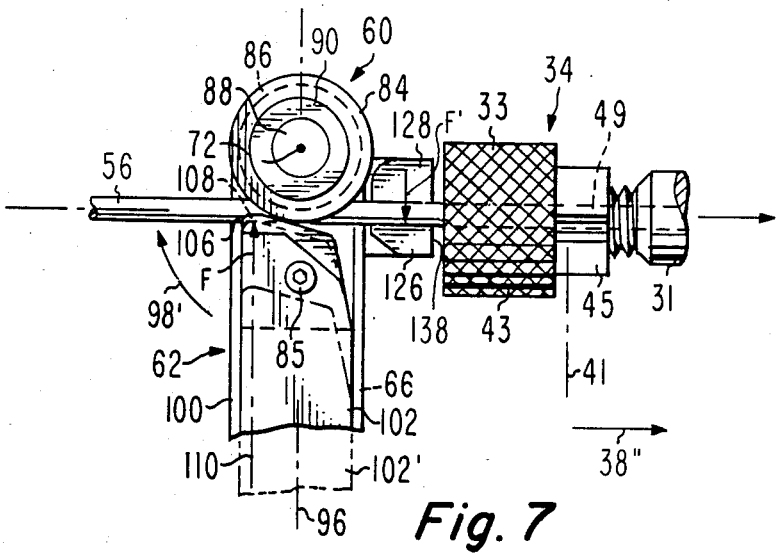
Figure 8:
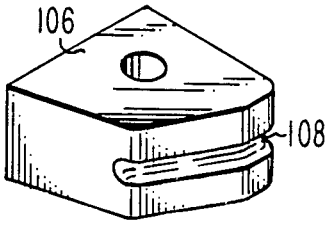

FIG. 4*a* is a sectional view similar to the view of FIG. 3*a* with the coaxial cable clamp in the idle position;

FIG. 4*b* is a sectional side elevation view of the apparatus of FIG. 1 similar to the view of FIG. 3*b* showing the coaxial cable clamp in the idle position;

FIG. 5 is a sectional view of the apparatus of FIG. 1 taken along lines 5—5 illustrating the bend and support dies;

FIGS. 6 and 7 are plan views of the coaxial cable bending portion of the apparatus of FIG. 1 with the clamps in the respective coaxial cable clamping and idle states;

FIG. 8 is an isometric view of a coaxial cable pressure die employed in the embodiment of FIG. 1; and FIG. 9 is an isometric view of a coaxial cable stop block assembly including a fixed cable support die employed in the embodiment of FIG. 1.

Figure 2:
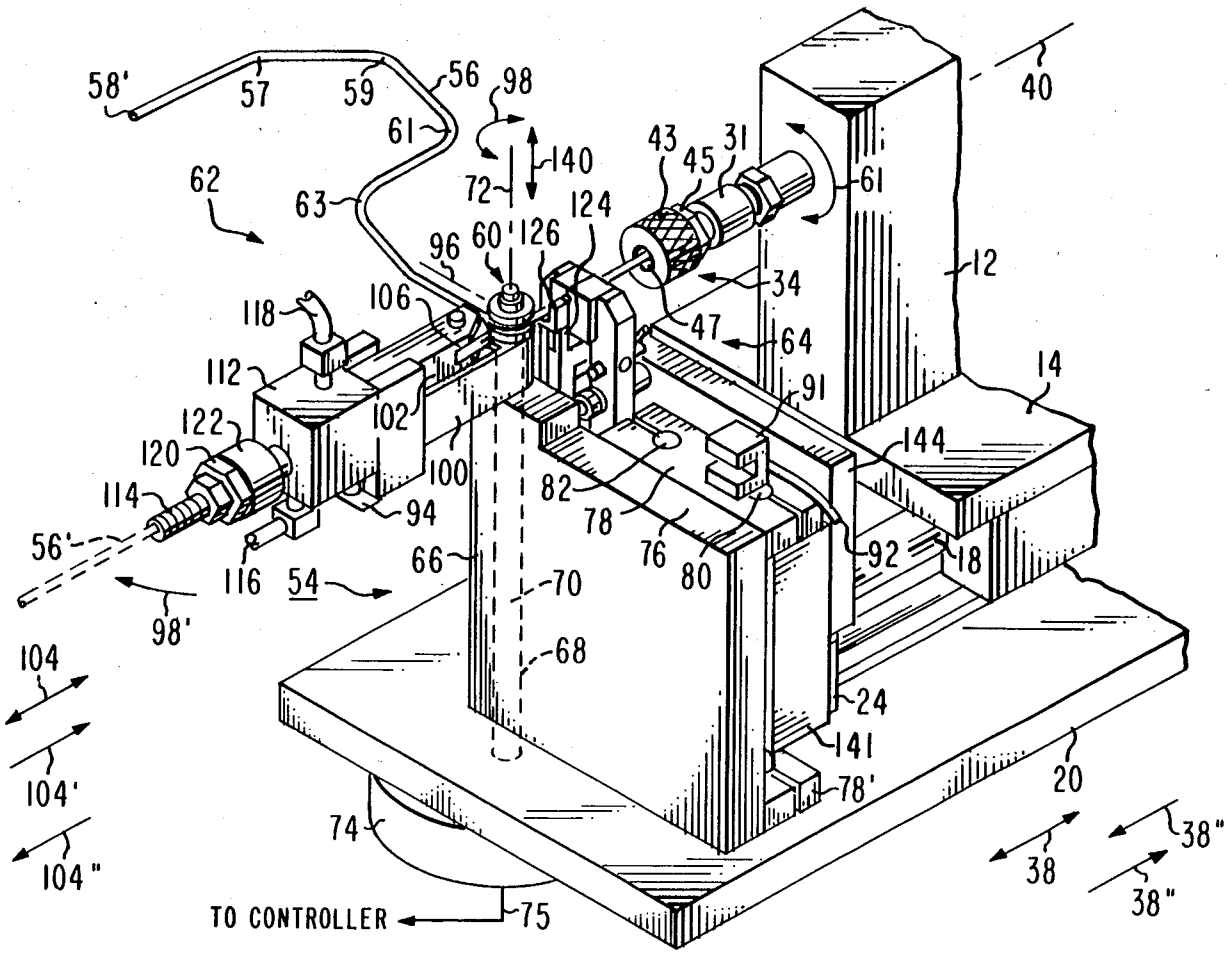
FIG. 2 is an isometric view of the bending portion of the apparatus of FIG. 1 further including a bent coaxial cable.

In FIGS. 1 and 2, coaxial cable bending apparatus 10 may be employed to bend tubes generally, but is particularly useful for bending coaxial cables having a rigid metal tubular outer conductor. Only so much of the apparatus 10 will be described as to make clear the environment of the present invention. Further details, including methodology for programming the controller of the system and related systems whose principles are well known or which are within the skill of one of ordinary skill in the computer programming art, will not be described in detail. One of ordinary skill can program and operate a conventional controller for performing the functions to be described below. The controller employed in the present embodiment is commercially available and was programmed to operate as described below by following the manufacturer's supplied programming instructions.

In FIG. 1, headstock 12 is secured to a carriage 14 having bearings (not shown) which ride on cylindrical rod-like guide rails 16 and 18. The rails 16 and 18 are secured to base 20 via bearing blocks 22 and 24 and supports between the rails and the base. An adjustable stop 27 secured to block 24 is adapted to abut carriage 14 at the end of the carriage travel in the forward direction 38'. Carriage drive screw 25 is rotatably secured to bearings 22 and 24 and selectively rotated in either of two opposite angular directions by stepping drive motor 26 through gear box 26' at the tailstock end. Motor 26 is driven by a signal on wire 21 cable 36 from controller 28. Carriage 14 moves in selected ones of directions 38 parallel to axis 40 to within a fraction of an inch, e.g., less than about 0.005 inch increments in response to control commands issued by controller 28.

Headstock stepping motor 30 is secured to gear box 32 which, in turn, is secured to headstock 12 for rotating collet chuck 34, secured to spindle 31, in response to an operating signal from controller 28 via cable 36 wire 37. Chuck 34 is concentric with axis 40 and is selectively rotatably driven about that axis by motor 30 to within a small fraction of a degree, e.g., one-sixth of a minute. Chuck 34 receives a relatively rigid unbent coaxial cable concentric with axis 40.

Secured to carriage 14 are a pair of hall effect sensors 42 and 44 which respectively mate with element 46 on bearing block 24 and element 48 on bearing block 22. When carriage 14 moves to its most forward position, direction 30', element 46 engages sensor 42 causing a signal to be transmitted on line 50 to controller 28. Controller 28 is programmed to slow the carriage 14 down in response to this signal and reverse the carriage displacement slightly to compensate for backlash, if any. When element 48 engages sensor 44, a signal is transmitted to controller 28 on line 52 indicating carriage 14 is most rearward. This signal is for safety purposes to stop the carriage in case spurious signals overdrive the carriage. A signal produced by sensor 42 indicating the headstock 12 is in the most forward of direction 38' represents the start of a given bend sequence.

As employed herein the term "bend sequence" means all bend actions performed on a given cable. A bend cycle means all actions to create a given bend in the cable. For example, the cable 56, FIG. 2, is shown with a number of bends 57, 59, 61, 63, and so on. Bend 57 may include the steps of displacing the bend point, e.g., the point of bend 57 to the bending assembly 54 to be described, forming the bend and then rotating the cable about axis 40. The displacement, bending, and rotation of the cable for a single bend are referred to as a cycle and all such cycles in a bend sequence are automatically completed regardless the number and locations of the bends in a given cable. The above bend functions will be described in more detail later.

Bending assembly 54 is secured forward of the headstock 12 and chuck 34. The bending assembly 54 comprises a bend die assembly 60 aligned on axis 72, FIG. 2, pressure die assembly 62 rotatable about axis 72 having a pressure die axially selectively displaceable along axis 96 and having cable engage and disengage states, and a cable clamp assembly 64 located between assemblies 60 and 62 and chuck 34 and having clamp and idle unclamped states.

In FIG. 2, cable 56 prior to bending is straight as represented by dashed lines 56'. One end of cable 56 is clamped by chuck 34 and pressure die assembly 62 is located at one side (as in FIG. 1). Chuck 34 is programmed to rotate cable 56 about axis 40 in directions 61. The rotation of the cable 56 in either of directions 61 and the carriage 14 displacements in either of directions 38 always occur with the bending assembly 54 in the cable disengaged idle state. In the idle state, the pressure die assembly 62 is aligned on axis 96 (FIG. 1) disengaged from the cable and the clamp assembly 64 is unclamped, FIGS. 4*a* and 4*b*. Cable support die 126, FIG. 2, and the bend assembly 60 support the cable 56 in the idle state as the cable 56 is displaced aligned with and parallel to axis 40 until a bend point on the cable is in position aligned with die assemblies 60 and 62 as will become clearer later. Cable 56 is not shown in FIG. 1 for clarity of illustration.

In FIG. 6, collet chuck 34 includes a commercially available tapered spring finger collet (not shown), a sleeve over the collet (not shown), and a settable torque nut assembly 33 over the sleeve and comprising a nut 43 and nut portion 45. The chuck 34 includes a cable stop 49 for locating the cable 56 end at a machine reference plane 41. When there is a given relative torque between nut 43 and portion 45, the nut 43 slips relative to portion 45. As nut 43 is rotated, the collet is forced to the right and radially compressed, direction 38″, due to the threaded engagement of nut portion 45 with spindle 31. The torque between nut 43 and portion 45 is set to produce a given radial clamping pressure on the cable sufficient to clamp the cable and yet preclude cable damage.

In FIG. 2, bend die assembly 60 includes an upstanding support 66 secured to base 20. Support 66 includes a shaft journal 68 through which passes drive shaft 70. Drive shaft 70 is rotatably driven about vertical axis 72 by stepping motor drive assembly 74. Motor assembly 74 is selectively operated by controller 28, FIG. 1, by signals on line 75 of cable 36.

In FIG. 5, the bend die assembly 60 includes a circular pulley-like rotatable bend die 84 having an annular groove 86 of semicircular concave cross-section. The radius of the groove 86 is the same as that of the cable 58 outer conductor to closely receive the cable without distorting the cable pressed thereagainst. The cable is bent around axis 72 in that groove such that the cable bend radius corresponds to the groove 86 radius relative to axis 72. The die 84 is secured to shaft 70 by screw 88 and washer stacks 90 and 92. Die 84 is also free to rotate about axis 72 relative to shaft 70, however, it cannot displace in directions normal to or parallel to axis 72. Die 84 makes semicircular line contact with cable 56 in the plane defined by intersecting axes 72 and 96, FIGS. 6 and 7.

Pressure die assembly 62, FIG. 2, is secured to the upper end of drive shaft 70 projecting beyond support 66. Rotation of drive shaft 70 about axis 72 rotates assembly 62 therewith in directions 98 in a horizontal plane. Pressure die assembly 62 includes an elongated base member 100 secured at one end to and driven by shaft 70 for automatic selective rotation about axis 72 any desired amount in a given range, for example, about 180° to an accuracy of a fraction of a degree. An elongated slide 102 is closely slidably secured to the base member 100 in a channel thereof for movement in the horizontal plane in radial directions 104 normal to axis 72. Slide 102 includes a pressure die 106 fixedly secured at the slide end adjacent bend die 84, FIG. 5, by screw 85. In FIG. 8, die 106 includes a groove 108, semicircular in cross-section and dimensioned similarly as groove 86 of bend die 84, FIG. 5, to closely receive cable 56. The groove 108 is shaped to provide substantially semicircular line contact on the cable similar to that of die 84, FIG. 5. Die 106 makes contact with the cable in plane 110, FIGS. 6 and 7, spaced from and parallel to axis 96. Die 106 may rotate about the axis of screw 85 and thus "float." In this case, screw 85 would be aligned on plane 110. In the alternative, die 106 may be a circular grooved disc similar to die 84 and secured for rotation about an axis lying in plane 110. As shown, the die 106 wipes against cable 56 during bending in direction 98′. This wiping action tends to preclude distortion of the cable 56 outer conductor as the cable is bent to retain the circular cross-section.

An air cylinder 112, FIG. 2, is secured to base member 100 and has a piston rod 114 connected to slide 102. Rod 114 is selectively moved in either of horizontal directions 104 which are parallel to axis 40 in the FIG. 2 orientation. Air cylinder 112 is driven by pressurized air supplied to hoses 116 and 118 under control of controller 28, FIG. 1. An adjustment nut 120 is threaded to the extended end of rod 114. Nut 120 sets the distance that the piston 114 may traverse in direction 104′ toward axis 72. Nut 120 includes a rubber bumper 122 which abuts the cylinder 112 body in the pressure die engage state.

Rotation of nut 120 about rod 114 sets the amount of travel that the slide 102 may traverse in the direction 104′ toward axis 72. Any pressure secures the slide in this position. The movement of the slide 102 in direction 104″ away from axis 72 disengages pressure die 106 from cable 56, permitting removal, axial or rotational displacement of the cable.

Nut 120 sets the amount of pressure of the die 106 on the cable 56 at the start of a bend portion of a cycle. The resultant bending pressure induced on the cable by die 106 thus commences at the desired time in a given cycle and does so without damaging the cable. For example, if the die 106 were to strike the cable 58 in interference relationship it would tend to undesirably compress or dent the cable 56 outer conductor upon initial contact. Should the pressure die 106 during a bending cycle not abut the cable at the start of the cycle in plane 110, FIG. 7, then as the bending assembly 62 rotates in that cycle the pressure die 106 may contact the cable 56 later in the cycle causing the bend to have an unknown angular extent. Therefore, it is critically important that the pressure die 106 just touch the cable at the initial point of a bend cycle and do so without damaging the cable. Nut 120 sets this critical point.

In FIG. 9, stop block assembly 124 includes a member 132 attached to support 66. Cable support die 126 is attached to member 132 by screws 133 and has a semicircular cylindrical curved surface 130 formed by legs 128 and 138. Surface 130 is concentric with axis 40, FIG. 1, and has a radius about the same as that of cable 56. During the bend sequence, the cable outer surface abuts surface 130 at all times. Leg 138 withstands the reaction forces of the cable during bending independent of the clamp assembly 64 and leg 128 supports the cable vertically.

In FIGS. 6 and 7, when the cable is bent by the rotation of bending assembly 62 about die 84 direction 98′, the pressure die 106 induces a force F on the cable in plane 110 and that bending force induces a second reaction force F′ on leg 138. Die 126 is rigid and fixed in place and, therefore, can withstand relatively high reaction forces F′. This tends to remove most of the reaction forces F′ from the movable parts such as clamp assembly 64, FIG. 6, and the collet chuck 34, FIG. 7, when the clamp assembly 64 is unclamped.

In prior art structures the reaction forces F′ are borne by movable parts, such as the clamps and the like, which, after extended exposure to such forces, tend to wear, exhibit play, and result in shifting of the position of the cable during bending, causing errors in the bend angle. Die 126 tends to preclude such wearing of movable parts. This results in a reliable, repeatable bend angle under control of controller 28 whose computer program causes the bending die assembly to always rotate the same angular extent for given desired bend angles and cable dimensions. Further, die 126 is a relatively inexpensive element and is easily replaced.

Support die 126, FIG. 5, serves an additional important function of supporting cable 56 when the pressure die 106 is disengaged from the cable 56, direction 140'', and the clamp assembly 64, FIG. 2, is in the idle unclamped state. In FIG. 5, groove 86 of die 84 in combination with legs 128 and 138 of die 126 tend to lock the cable 56 therebetween. Legs 128 and 138 support cable 56 when the carriage 14 and the attached cable is moved rearward toward the bearing block 22, FIG. 1. In so moving, a cable length, for example, four feet for a 0.141 inch diameter rigid cable, may extend from chuck 34 and otherwise tend to flex out of position relative to the pressure die 106 and bend die 84, FIG. 5. In an automatic system it is important that the free unclamped end be in a given alignment at all times as the carriage displaces and that relative displacement of the cable during such carriage motions should not damage the outer conductor.

Die 84 tends to rotate during cable axial displacement in directions 98, FIG. 2, because of the friction with the cable. This minimizes wear of die 84 and damage to the cable. Die 106 is disengaged during such displacement and is not effected thereby. Die 126 is made of hardened steel and polished smooth where it contacts the cable at legs 128 and 138 to minimize friction with the cable as it moves. In FIG. 5, the cable 56 is held in its desired alignment on axis 40, FIG. 2, regardless the clamp states of the pressure die 106 and clamp assembly 64 (FIG. 6).

In FIG. 9, assembly 124 further includes a stop block 134 having a clamp alignment screw 136 which displaces in vertical directions 140. Stop block 134 locates the vertical clamp position of the clamp jaws, as will be now described.

An additional important feature of the present apparatus is the clamp assembly 64 which can be raised in vertical directions 140, FIG. 2, parallel to axis 72 to a clamping position, FIGS. 2, 3*a*, and 3*b* and lowered to an idle position out of the way of the chuck 34, FIGS. 4*a* and 4*b*. In the latter position, the significance of the support provided cable 56 by support die 126 is readily apparent.

In FIG. 2, clamp assembly 64 includes a member 78 secured to support 66 adjacent to support upper edge 76 and member 78' secured to base 20 vertically aligned with member 78. A pair of vertical rod-like clamp assembly 64 guide rails 80 and 82 are secured to and between members 78 and 78' in spaced relationship parallel to axis 72. In FIGS. 3*a* and 3*b*, clamp assembly 64 is in the raised clamp position. The assembly includes a slide 141, FIG. 3*a*, slidably secured to rails 80 and 82 for selective reciprocation in vertical directions 142 between members 78 and 78'. Slide 141 includes a clamp mounting plate 144, a guide block 146 and a stop 148. In FIG. 3*b*, screw 136 of stop block 134 abuts stop 148 in the uppermost relative vertical position of plate 144 to set the vertical alignment of the clamp jaws 162 and 164 (FIG. 3*a*) to axis 40. Also secured to plate 144 are a pair of spaced bearing shafts 150 and 152, FIG. 3*a*. Not shown are roller bearings used through the structures. Clamp arms 154 and 156 are mirror images and are journaled to respective bearing shafts 150 and 152 attached to plate 144. Cam follower rollers 158 and 160 are pivotally secured to the lower extended end of respective arms 154 and 156. Clamp jaws 162 and 164 are identical and are releasably secured to the respective ends of arms 154 and 156. The jaws 162 and 164 each have a semicircular groove 162' and 164', respectively, which match the cable outer diameter. These grooves are aligned by screw 136, FIG. 3*b*, in the vertical direction concentric with axis 40 in facing relationship when closed.

In FIGS. 4*a* and 4*b*, the jaws are held in the open state by torsion spring 166 coupled to arms 154 and 156 and stop 148. Adjustment screws 168 and 170 are secured to respective arms 154 and 156. The screws 168 and 170 abut stop 134 when plate 144 is at its uppermost vertical position. These screws independently adjust the position of the grooves 162' and 164' relative to axis 40, FIG. 3*b*, in a horizontal plane normal to the adjustment direction of screw 136. These screws set the clamp jaw pressure on the cable to preclude cable damage and to prevent axial and transverse cable movement during bending when the chuck 34 is located relatively far from the bend die assembly 60. The support die 126, however, absorbs the brunt of the bending forces while the clamp jaws assist in holding the cable in place.

Actuator assembly 172, FIGS. 3*a* and 3*b*, displaces the clamp mounting plate 144 in vertical directions 142. Assembly 172 includes an air cylinder 174, piston rod 176, and a collar 178 secured to cam 180 which is threaded to rod 176. Cam 180 has a conical camming tip 182. A compression spring 184 surrounds the cam 180 between collar 178 and guide block 146. Cam tip engages rollers 158 and 160 for opening and closing the jaws.

The air cylinder 174, FIG. 3*b*, is operated under control of controller 28, FIG. 1, and also by a signal passed by a carriage-locating switch (not shown) attached to carriage 14, FIG. 1. The switch is closed when the chuck 34 approaches the clamp assembly 64 in the forward direction 38'. When the switch is closed, the clamp jaws automatically disengage and lower. The controller 28 also overrides the open state of the switch for automatically raising and lowering the clamp assembly as required for a given bend cycle when there is room to clamp the cable.

By locating the cable 56 end within collet chuck 34 and by lowering the clamp assembly 64 to the position shown in FIGS. 4*a* and 4*b*, the reference plane 41 at the cable tip can be located closely spaced to the bending assembly 62, FIG. 7 and this spacing may be less than an inch.

In FIGS. 4*a* and 4*b*, rod 176 is lowered, the cam tip 182 is disengaged from rollers 158 and 160 and the compression spring 184 is expanded. The clamp jaws remain lowered during axial displacement of the cable in the directions 38, FIG. 1, during cable rotation in directions 61, FIG. 2, and during the bend cycle of a bend close to the cable tip in chuck 34.

Assuming a bend is about to be made, rod 176 is forced upwardly in direction 142' to close the clamp jaws 162 and 164, FIGS. 3*a* and 3*b*. As rod 176 moves upwardly, collar 178 forces compression spring 184 against guide block 146. The spring in the expanded state, forces the guide block 146 and clamp mounting plate 144 to displace vertically in direction 142'. This displacement action continues until stop 148 abuts screw 136. Clamp grooves 162' and 164' are now aligned with axis 40. Further, upward movement of rod 178 compresses spring 184 causing cam tip 182 to engage rollers 158 and 160, and close the jaws while the jaws are in their clamp position at axis 40. The cam tip 182 cams rollers 158 and 160 apart until the arm screws 168 and 170, FIG. 3*a*, abut stop 134 on stop block 124.

When the cable clamp assembly 64 is lowered to the position of FIGS. 4*a* and 4*b*, the guide plate 146 is lowered to its lower-most position which permits the clamp mounting plate 144 to drop via gravity, dropping the clamp arms and clamp jaws accordingly. The torsion spring 166 biases the jaws sufficiently apart so that they clear the stop 134 in the lowered position.

Secured to member 78, FIGS. 1 and 2, is a hall effect sensor 91 which is coupled by line 92 via cable 36 to controller 28. The pressure die assembly 62 includes an element 94 which mates with the sensor 91 for producing a signal on line 92. When element 94 mates with sensor 91, assembly 62 is oriented as shown in FIG. 1 and is aligned on axis 96 normal to axis 40.

In operation, the controller 28, FIG. 1, is supplied a set of instructions which may be on cassette tape to control the various motions of the bending apparatus corresponding to a given set of bend dimensions. The apparatus 10 is always in the initial start reference position at the start of a bend sequence with the collet chuck 34 closely spaced to the support die 126, FIGS. 4*b* and 7. The clamp jaws are in the idle lowered condition, FIGS. 4*a* and 4*b*. Sensor 42, FIG. 1, is coupled to element 46 and provides a signal on line 50 to the controller 28 indicating that the reference plane 41 is so positioned. The sensor 91, FIG. 1, is coupled to element 94 on the bending assembly 62 and provides a signal indicating that the bending assembly 62 is in the initial position ready to start. The slide 102, FIG. 2, is normally in the disengaged position, direction 104″ with pressure die 106 spaced away from bend die 84. A straight length of cable to be bent is assembled in the groove 86 of die 84 abutting surface 130 of support die 126, FIG. 5, and placed in chuck 34 until the tip of the cable end 58 abuts the chuck stop 49 at plane 41, FIG. 7. The cable is then secured to the chuck.

The bending sequence starts after the necessary adjustments are made for a given cable diameter. With the carriage 14 in the initial reference position, it is displaced rearward, direction 38″, FIG. 1, to the first bend position. If the cable is long, its extended free end may be supported by a separate grooved pulley support structure (not shown) forward of the apparatus. As the carriage displaces rearward or forward, it respectively pulls or pushes the cable therewith through the bending assembly 54. The support die 124 and bend die 84 support the cable as it is so displaced. As shown in FIG. 5, the cable automatically remains in position ready for a given bend cycle at any point along the cable. Assuming bend 57, FIG. 2, is the initial bend to be made, carriage 14 moves until the cable point corresponding to bend 57 is adjacent disengaged pressure die 106, FIG. 5 (dashed line 106′).

At this time, the clamp jaws of assembly 64, FIG. 2, are raised by a signal from the controller 28 and clamp the cable (the carriage switch (not shown) is open indicating that there is room for the raised clamp assembly). Controller 28 activates cylinder 112 displacing slider 102 in radial direction 104′ engaging the pressure die 106 with the cable 56, FIG. 5. Controller 28 then operates motor assembly 74, FIG. 1, and bend die 84, rotating bending assembly 62 in direction 98′ the desired angular extent. The controller is programmed to provide previously empirically determined overbend of the cable to allow for springback. At the end of the bend motion in direction 98′, the pressure die 106 is disengaged from cable 56 in direction 104″ and assembly 62 then rotated back to the idle position of FIG. 1. The clamp jaws are lowered and, if necessary in a given implementation, the cable may be rotated about axis 40. The carriage 14 then moves forward, direction 38′ pushing cable 56 through assembly 54.

When the second bend point, for example, the point of bend 59 reaches plane 110, FIG. 7, adjacent die 106, the carriage stops, the cable is rotated if necessary, the clamps are raised and closed, and the pressure die 106 engages the cable, and so on. The process then repeats for all bends. If the last bend is close to chuck 34, the closed carriage switch lowers the clamp jaws. In this case, the close proximity of chuck 34 to support die 126 acts in place of the clamp jaws to restrain lateral and axial displacement of the cable. The support die 126 supports the bending reaction forces, permitting the chuck to merely absorb relatively low value axial displacement forces.

The slide 102, FIG. 2, is released in directions 104″ at the end of rotation in direction 98′ to free the cable end and permit it to be drawn back with no damage. The bending die 84 is permitted to rotate on axis 72 as the cable is displaced in directions 38 to minimize friction wear. The surface 130 of support die 126 is made smooth and polished so that the cable outer surface is not damaged as it is displaced in sliding engagement with surface 130. The pressure die line contact with the cable accurately and without damaging compressive stress on the cable automatically engages the cable in plane 110 and releases the cable during the cable axial displacement portion of a cycle. The pressure die, during bending may wipe along the cable surface or roll therewith, in the alternative. This action tends to maintain the circular cross-section of the cable minimizing distortion that might otherwise occur.

What is claimed is:

1. An automatic coaxial cable bending apparatus comprising:

a base;

a chuck for automatically securing and locating an end of said cable at a reference point on a given axis;

cable positioning means secured to the base for automatically selectively moving said chuck so that said reference point and cable end are displaced to a second point on said axis and including means for selectively rotating said chuck and said cable about said axis;

bend means secured to the base including a cable pressure die for automatically engaging and bending said cable at a third point spaced a predetermined distance from the second point, said bend means further including a bend die rotatable about a stationary axis relative to the base and a stationary cable support die fixed in place to the base relative to the bend die to support bending loads induced by said cable during said bending, said bend and support dies being adapted to support the cable during said selective moving of the chuck, said pressure die being secured to rotate relative to and about the bend die in a direction away from said support die during the bending engaged state and to automatically return to the initial position in the opposite direction; and clamp means secured to the base adjacent to said support die adapted to selectively hold said cable in a first clamp region between said support die and said chuck and to selectively displace to a second idle region, said cable positioning means including means selectively displacing said chuck adjacent said bend means in said first region when said clamp means are in the idle region.

2. The apparatus of claim 1 wherein said clamp means includes a pair of arms and first and second clamp jaws, each jaw being releasably secured to a separate different arm, each pivotally secured relative to the base, and locating means secured to the base in fixed position between said arms, each said arm including adjustment means adapted to abut said locating means when the jaws are in a cable clamp position in the first region for independently setting the position of each jaw relative to said axis passing therebetween in a given direction to thereby set the clamp pressure of each said jaws on said cable.

3. The apparatus of claim 2 wherein said clamp means includes clamp displacement means, said displacement means including drive means secured to the base for displacing said clamp jaws to said first and second regions and a cam coupled to said drive means for automatically causing said clamp jaws to close after being displaced into said first region.

4. The apparatus of claim 3 wherein said clamp means includes adjustment means for aligning said clamp jaws relative to said axis in a direction substantially normal to the given direction of said arm adjustment means.

5. The apparatus of claim 1 wherein said pressure die includes means for setting the spacing of said pressure die to said bend die.

6. The apparatus of claim 1 wherein the pressure die, bend die, support die, and clamp means are each adapted to closely engage a cable of a given diameter, said apparatus including means for releasably securing each said dies and clamp means for processing cables of different diameters.

7. An automatic coaxial cable bending apparatus comprising:

a base;

a chuck adapted to receive, clamp and locate an end of the cable at a reference location on a first axis;

first drive means secured to the base for automatically selectively displacing the chuck parallel to said axis;

second drive means coupled to the chuck for automatically selectively rotating the chuck about said axis;

a bend die rotatably secured to the base in fixed relation to a second axis normal to the first axis;

a pressure die having engaged and disabled states rotatably secured to the base for automatic rotation about the second axis and the bend die for bending the cable about said second axis in an engaged state;

clamp jaw means movably secured to the base and located between said bend die and said chuck, said clamp jaw means including a pair of clamp jaws positioned so that said first axis passes therebetween in a clamp position in a first region;

clamp jaw locating and operating means for automatically and selectively displacing the clamp jaws to said first region and to an idle position in a second region spaced from the first region, said first drive means including means for locating said chuck closely adjacent to said bend die in said first region when the clamp jaw means are in the idle position, said jaw operating means including means for automatically selectively opening and closing the jaws in said first region to preclude sliding of the clamped cable during said bending when said chuck is distal said bend die; and cable support means for supporting said cable on said axis between said clamp jaw means and said bend die.

8. The apparatus of claim 7 wherein said clamp jaw locating and operating means includes clamp displacement means secured to the base, a support movably secured to the base, said jaw means including a pair of jaw support arms pivotally secured to said support and normally biased with the jaws open, said clamp displacement means including a drive element coupled to the support for displacing the jaws to said first and second regions, said drive element and support arms being adapted such that said drive element automatically engages said arms to close said jaws after the jaws are placed in the first region.

9. The apparatus of claim 8 wherein said arms and base include adjustable locating means for independently setting the spacing of each jaw relative to said first axis in a direction normal to the first axis.

10. The apparatus of claim 8 wherein said locating and operating means includes means for adjustably setting the location of said jaws in the first region relative to said first axis in a first direction toward and away from the second region, and means for adjustably independently setting the relative spacing of each said jaw to said first axis in a second direction approximately normal to the first direction.

11. In an automatic coaxial cable bending apparatus including a base, a chuck movably secured to the base for locating, grasping, and moving a coaxial cable to be bent lying on an axis, and coaxial cable bending means secured to the base for bending the grasped coaxial cable, coaxial cable clamp means in combination therewith for holding the coaxial cable during said bending comprising:

guide means secured to the base;

a support member slideably secured to the guide means for displacement in a direction between and to a clamping position and an idle position;

a pair of clamp jaws releasably secured to a pair of support arms, a different jaw being secured to a separate, different arm, said arms being pivotally secured to the support member at a location between said chuck and said bending means;

clamp drive means secured to the base and coupled to the support member for displacing the clamp jaws to said clamp idle position in a first region spaced from said axis and to said clamping position in a second region lying on said axis;

a cam coupled to the clamp drive means and said support arms for closing said jaws only when said jaws are in said clamping position second region; and a cable support fixedly secured to the base between said bending means and said chuck for automatically supporting said cable at said axis regardless the clamped state of said jaws, said support including means for supporting cable bend loads during said bending, said apparatus including means for selectively placing said chuck in said second region only when said clamp jaws are in the first idle position.

12. The apparatus of claim 11 including a jaw locating member secured to the base and adjustment means coupled to the arms and locating member adapted to abut said locating member for settably locating said clamp jaws in reference locations relative to said axis in two different directions normal to said axis.

13. The apparatus of claim 12 wherein said adjustment means includes a plurality of screws coupled to said arms for independently setting the position of each arm relative to said locating member when the jaws are closed in the clamping position.

* * * * *